US008602885B2

(12) United States Patent
Arezina et al.

(10) Patent No.: US 8,602,885 B2
(45) Date of Patent: Dec. 10, 2013

(54) PROXIMITY BASED GAME CUSTOMIZATION

(75) Inventors: Vladimir Arezina, Chicago, IL (US); Srinivyasa M. Adiraju, Vernon Hills, IL (US); Matthew Fitzsimons, Lake in the Hills, IL (US); Ryan S. Mak, Chicago, IL (US); Samuel D Ralston, Chicago, IL (US); Vikram Swamy, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 1973 days.

(21) Appl. No.: 11/275,295

(22) Filed: Dec. 22, 2005

(65) Prior Publication Data

US 2006/0148560 A1 Jul. 6, 2006

Related U.S. Application Data

(60) Provisional application No. 60/641,554, filed on Jan. 5, 2005.

(51) Int. Cl.
*G07F 17/32* (2006.01)

(52) U.S. Cl.
USPC ..... 463/29; 463/16; 463/20; 463/25

(58) Field of Classification Search
USPC ..... 463/42, 16–20, 25–29
See application file for complete search history.

(56) References Cited

U.S. PATENT DOCUMENTS

| | | | | |
|---|---|---|---|---|
| 7,040,987 | B2 * | 5/2006 | Walker et al. | 463/42 |
| 7,357,299 | B2 * | 4/2008 | Frerking | 235/375 |
| 2002/0198044 | A1 * | 12/2002 | Walker et al. | 463/25 |
| 2005/0215310 | A1 * | 9/2005 | Boyd et al. | 463/20 |

* cited by examiner

*Primary Examiner* — Omkar Deodhar
(74) *Attorney, Agent, or Firm* — Schwegman, Lundberg & Woessner, P.A.

(57) ABSTRACT

Potential player proximity to a gaming machine is sensed, and used to customize the gaming machine. The potential player position may be sensed in different manners including via an ID card carried by the potential player with triangulation sensors, a cell phone, or via biometrics. The identity of the player is also associated with the ID card, and is used to access a database containing information about the potential player or type of player. Based on that stored information, the proximate gaming machine may be customized with a game or various attract modes that are more likely to attract the potential player. In further embodiments, information known to be desired by the potential player, such as sporting results may also be displayed to attract the potential player. In still further embodiments, various profiling techniques may be utilized to identify desired customizations of proximately located gaming machines.

30 Claims, 3 Drawing Sheets

PROXIMITY BASED GAME CUSTOMIZATION

RELATED APPLICATION

This application claims priority under 35 U.S.C. 119(e) from U.S. Provisional Application Ser. No. 60/641,554 filed Jan. 5, 2005, which application is incorporated herein by reference.

TECHNICAL FIELD

The present invention pertains generally to casino gaming, and more particularly to methods, systems, and software for proximity based game customization in a gaming establishment.

LIMITED COPYRIGHT WAIVER

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever. Copyright© 2005, WMS Gaming Inc.

BACKGROUND

The gaming industry has grown increasingly competitive and sophisticated in recent years. As such, it has become increasingly important to deliver the highest possible quality of gaming experience for each and every player. This both assures that the player will have a satisfying experience and that the gaming establishment has the best possible chance to maximize revenue and profit from each player.

Idle gaming machines are machines that are not currently being used. Such machines may be placed in an attract mode, which displays images and sounds designed to attract potential players so the machine becomes active and revenue producing. The gaming machine may also be preprogrammed with a set of one or more games. Much research has gone into designing attract modes that are appealing to potential players. However, no one attract mode or set of games is optimal for attracting all of the different potential players in a gaming establishment.

SUMMARY

Potential player proximity to a gaming machine is sensed, and used to customize the gaming machine. In one embodiment, the potential player position is sensed via an ID card carried by the potential player with triangulation sensors. The identity of the player is also associated with the ID card, and is used to access a database containing information about the potential player or type of player. Based on that stored information, the proximate gaming machine may be customized in one of many different manners.

In one embodiment, the gaming machine is loaded with a game that is more likely to be desired by the potential player. Settings for the game, such as payouts and betting modes may be modified as a function of the stored information. Attract modes of the gaming machine may also be modified to be more attractive to the potential player. In further embodiments, information known to be desired by the potential player, such as sporting results may also be displayed to attract the potential player.

In still further embodiments, a group of people may be sensed proximate a gaming device in use. Nearby gaming machines may be customized with a selected game, such as the same or similar game to attract potential players from the group which are likely watching the play on the gaming device in use.

In further embodiments, a cell phone or other device may be used to locate and identify a potential player, such as by triangulation. Biometrics may be used to locate and identify potential players in yet further embodiments. In still further embodiments, various profiling techniques may be utilized to identify desired customizations of proximately located gaming machines.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

The functions or algorithms described herein are implemented in software or a combination of software and human implemented procedures in one embodiment. The software comprises computer executable instructions stored on computer readable media such as memory or other type of storage devices. The term "computer readable media" is also used to represent carrier waves on which the software is transmitted. Further, such functions correspond to modules, which are software, hardware, firmware or any combination thereof. Multiple functions are performed in one or more modules as desired, and the embodiments described are merely examples. The software is executed on a digital signal processor, ASIC, microprocessor, or other type of processor operating on a computer system, such as a personal computer, server, state machine or other computer system.

Figure 1:
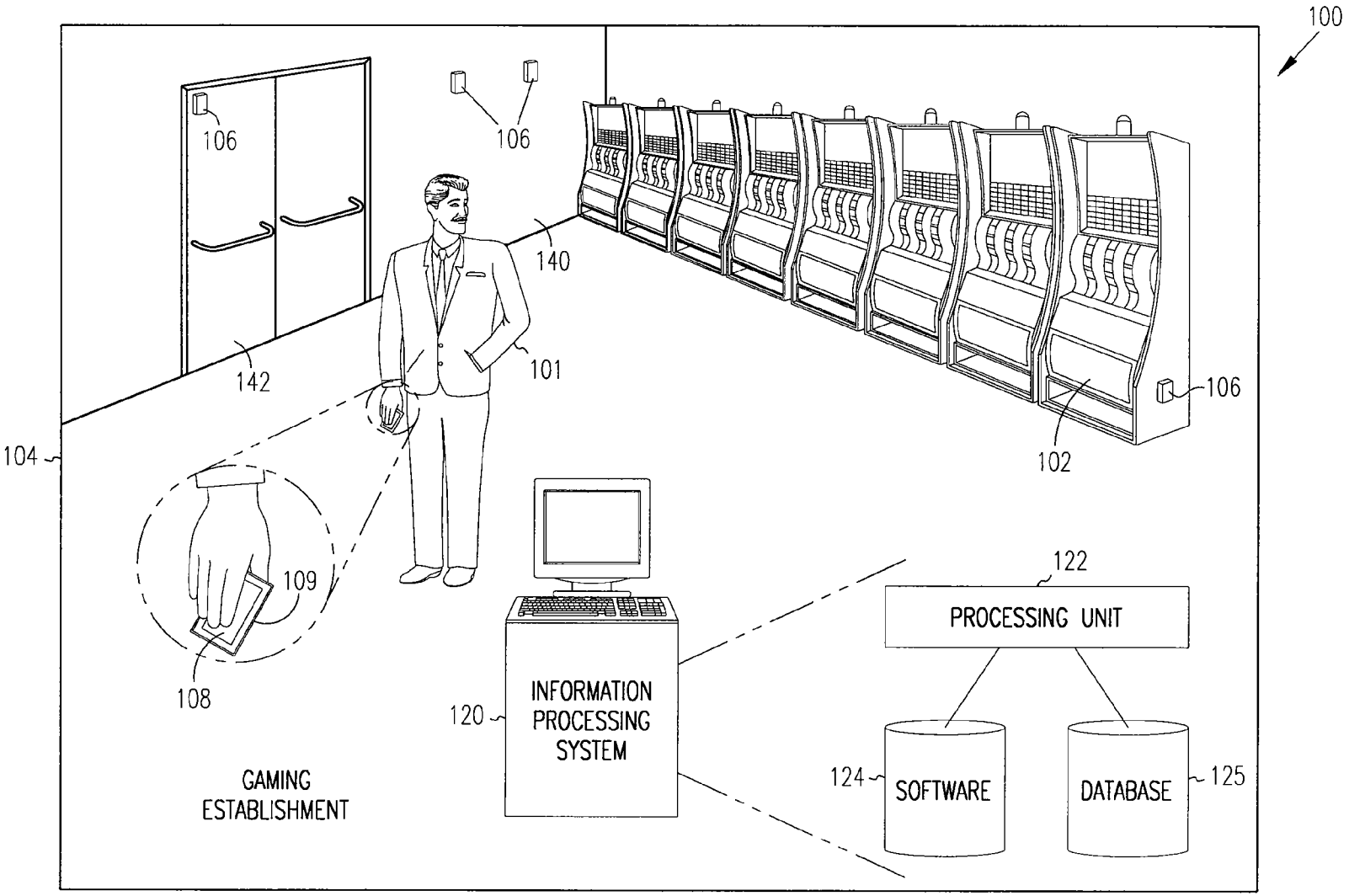
FIG. 1 is a block diagram illustrating a gaming establishment according to an example embodiment.

In FIG. 1, a system 100 tracks individuals 101 in a gaming establishment 104 such as a casino in which a number of casino games 102 are deployed. The individuals are provided with and carry or wear a radio frequency identification (RFID) tag 108 which may be active or passive. RFID tag 108 may be, for example, embedded or mounted in a plastic carrier 109, such as a picture identification card. A RFID tag 108 is, in one example embodiment, capable of emitting one or more signals that can be used by a reader component 106 mounted in or on or proximate a casino game 102. The reader component reads the RFID tag 108 and obtains information stored in the tag that can be used to uniquely identify it. Accordingly, when an individual 101 brings a RFID tag 108 into proximity to a reader component 106, the reader component 106 detects one or more signals from the device 108. The reader component 106 in turn generates one or more signals or data that is indicative of the identity of the RFID tag. Thus, by virtue of knowing the location of the reader component 106, the location of the RFID tag 108 can be ascertained. Other methods of identifying an individual or potential player include the use of GPS devices on the individual, biometric identification systems or other methods.

A system 120 is provided for processing and recording data collected from RFID tags 108. Reader component 106 is configured to communicate with an information system 120 through a communication channel which may be wireless or wired in various embodiments. Information system 120 may be disposed in the gaming establishment 104 or at a remote site. System 120 includes at least one processing unit 122 and software 124 operable on the system to record and process data read from RFID tags 108 as read by the tag reader components 106. Through the processing of this data and using other stored data, system 120 can track the position of an individual 101 in the gaming establishment 104 To provide this functionality, software 124 additionally operates to maintain a database 125 of records representing individuals 101, reader components 106 and the casino game they are associated with, RFID tags 108 and the individuals they are assigned or associated with, and the location of RFID tag 108 over a desired period of time. Accordingly, the recorded RFID location information (as determined by the detection of such RFID tags at a casino game 102) allows system 120 to track the location, movement, and game play of an individual 101 in the casino.

Database 125 also includes information regarding the gaming habits and preferences of individuals, as well as interests, such as favorite sports and sporting teams, news preferences, outside interests, and other items of interest that are known. Gaming habits and preferences may include information about favorite games, and preferences for the games, such as payout amounts. Using the location information and information in the database 125, the information processing system may customize nearby idle gaming machines that are likely to be observable by the individual in the individual's present location. Such gaming machines are said to be proximate to the individual, and may be customized to play a selected game, or provide a specific attraction mode designed to attract the particular individual. Such proximate gaming machine or machines may be customized to display things of interest to the individual, such as sporting event scores or clips. Sounds may be provided that are likely to attract the user, such as music, or gaming sounds.

In one embodiment, the location of a user at a point in the future is predicted, allowing time to customize a gaming machine that may be near the user at that time. The location may be predicted by extrapolating the user position based on several past known locations and times at such locations.

In some embodiments, groups of potential players may be observing a game being played on one gaming machine. Multiple other unused proximate gaming machines may be customized to provide the same or a similar game to attract idle potential players in the group.

Figure 2:
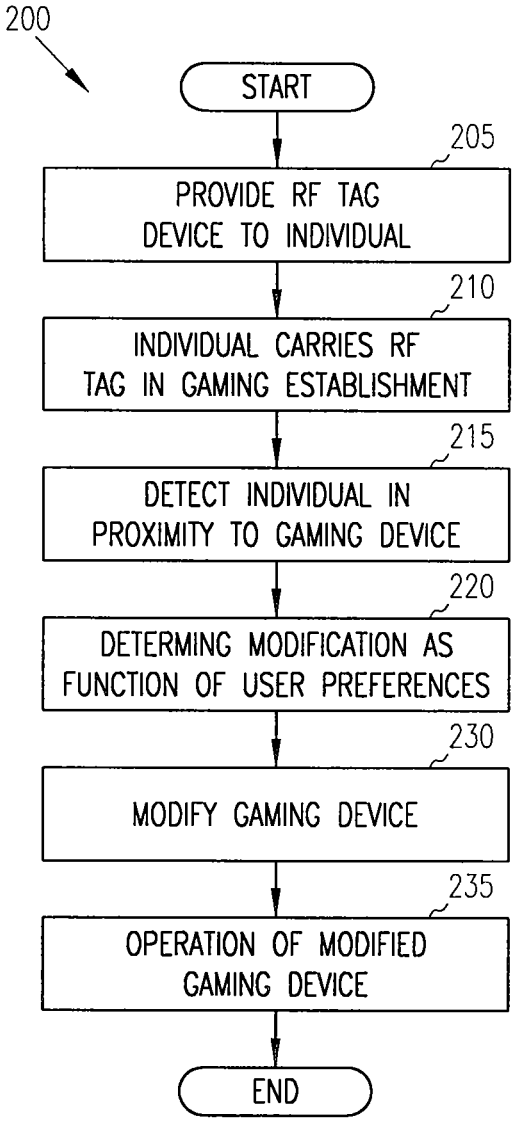
FIG. 2 is a flow chart illustrating a process for customizing a gaming device as a function of potential players in proximity to the gaming device according to an example embodiment.

FIG. 2 is a flowchart illustrating a process 200 used to customize proximate games. Starting at 205, a tracking device that includes an RF tag device is provided to an individual in a gaming establishment. The device is encoded with information identifying the individual, and a device ID is stored in database 125 or other suitable storage medium for use by processing unit 122. At 210, the individual carries the RF tag devices as they wander about the gaming establishment. At 215, the individual is detected in proximity to an unused gaming device game by a RF tag device reader situated in or near the gaming device game. At 220, the processing system 120 consults database 125 to determine a gaming device modification that is likely to attract the individual to the game. At 230, the gaming device is modified and loaded with appropriate parameters based on the database 125 information such that it is customized.

The customized gaming device at 235 begins operating in the customized manner to attract the individual. The customized manner of operation may be an idle form such as attract mode, with commercials, themes, demos, playing incentives, language of operation, offers to donate a percentage to selected charities. The customized manner of operation may also take place from the information when the player actively interacts with the gaming device, such as displaying buddy lists, themes, denoms, sport book actions and results, general entertainment, a list history of players and language of operation. It may even appear personalized, with specific information about the individual, such as their high scores on a particular game.

As used herein, the term casino game or gaming device encompasses, without limitation, slot machines, video poker machines, roulette tables, poker tables, craps tables and any other game of chance offered by a gaming establishment wherein for example the game qualifies as regulated and/or licensed gaming equipment. The term gaming establishment refers to an establishment that offers casino gaming experiences to its patrons and, in one example embodiment, is licensed by a gaming regulatory authority to provide such gaming experiences.

Figure 3:
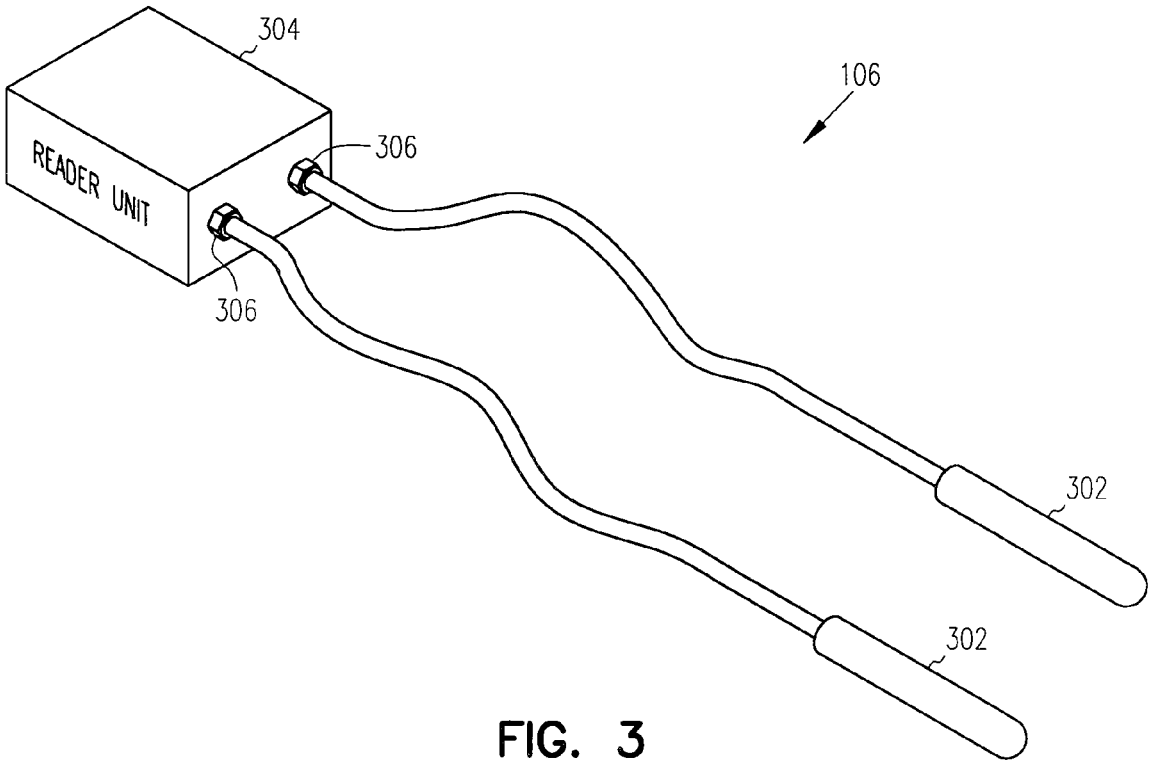
FIG. 3 is a schematic block diagram of a reader unit for identifying potential players in the gaming establishment of FIG. 1.

In FIG. 3 further detail of the reader component 106 is shown. The reader component 106 may be positioned in or on the game 102 may be a reader unit 304 that supports at least one antenna 302 that is co-located with the unit 304, such as the stationary reader model RDR-001, sold by Matrics, Inc., of Columbia, Md., U.S.A. The antenna 302 may be the general purpose antenna model number ANT-001 also available from Matrics, Inc. In the alternative, a reader unit 304 may support two or more antennas 302 that are located remotely from unit 304. RFID tag 108 may be, for example, the EPC Version 1 UHF RFID tag available from Matrics, Inc.

Radio frequency identification, or RFID, is a generic term for technologies that use radio waves to automatically identify individual items. Smart cards may also be used. There are several methods of identifying objects using RFID tags, such as tags 108. One of the most common is to store a serial number that identifies an item, thing, or person (such as an individual carrying an RFID tag 108), and perhaps other information, on a microchip that is attached to an antenna (the chip and the antenna together are called an RFID transponder or an RFID tag). The antenna enables the chip to transmit the identification information to a reader. The reader converts the radio waves returned from the RFID tag into a form that can then be passed on to, for example the system 120, that can make use of it. While it depends on the particular RFID tag and the application, one example embodiment of a RFID tag 108 carries about 2 KB of data—enough to store some basic information about the item or person it represents.

As described in various configurations below, an RFID system such as system 101 may comprise a RFID tag 108, which is made up of a microchip with, for example, a coiled antenna, and an interrogator or reader with an antenna, referred to herein in some instances as a reader component 106 generally, or more specifically as may be provided in some embodiments as a reader unit 304 and antenna 302. Reader unit 304 may include an integral or co-located antenna, or it may be deployed with one or remote antennas deployed at some distance from the unit 304. Remote antennas may be coupled to the reader unit 304 with a wireline connection. The reader 304 generates electromagnetic waves from the antenna 304 that form a magnetic field when they "couple" with the antenna on the RFID tag. According to one example embodiment, system 101 uses passive tags that have no battery. These passive tags draw power from the reader, which sends out electromagnetic waves that induce a current in the tag's antenna. The RFID tag draws power from this current and uses it to power the microchip's circuits. The chip then modulates the waves that the tag sends back to the reader and the reader converts the new waves into digital data. Most passive RFID tags simply reflect back waves from the reader. Energy harvesting, on the other hand, is a technique in which energy from the reader is gathered by the tag, stored momentarily, and transmitted back at a different frequency.

According to another example embodiment of the RFID tags 108, there are provided active RFID tags that have a battery, which is used to run the microchip's circuitry and to broadcast a signal to a reader (for example like the way a cell phone transmits signals to a base station). Semi-passive tags can also be used in the embodiments herein, and use a battery to run the chip's circuitry, but communicate by drawing power from the reader. Active and semi-passive tags are useful for tracking items that need to be scanned over long ranges, but they cost more than passive tags. The read range of passive tags may not be as far as active tags, for example for some example technology, less than ten feet as opposed to one-hundred (100) feet or more for active tags. More particularly, the read range of passive tags depends on many factors: the frequency of operation, the power of the reader, interference from metal objects or other RF devices. In general, low-frequency tags are read from a foot or less. High frequency tags are read from about three feet and UHF tags are read from 10 to 20 feet. Where longer ranges are needed, active tags use batteries to boost read ranges to 300 feet or more.

Radio frequency identification in system 101 does not require line of sight. RFID tags can be read as long as they are within range of a reader. Radio waves travel through most non-metallic materials, allowing RFID tags or the readers to be embedded in packaging or encased in protective plastic for weather-proofing and greater durability. Or, in the alternative, the reader component 106 can be mounted in a housing provided that the radio waves can traverse the housing, either by going through a wall, window or opening in the housing. However, reading an RFID through a metallic barrier can be more difficult.

RFID tags and readers have to be tuned to the same frequency to communicate. RFID systems can use many different frequencies, but generally the most common are low-(around 125 KHz), high-(13.56 MHz) and ultra-high frequency, UHF (850-900 MHz) or 5.8 GHz and 433.92 MHz. Microwave (2.45 GHz) is also used in some applications. Different frequencies have different characteristics that make them more useful for different applications. For instance, low-frequency tags are cheaper than ultra high frequency (UHF) tags, use less power and are better able to penetrate non-metallic substances. UHF frequencies typically offer better range and can transfer data faster. But they use more power and are less likely to pass through materials. And because they tend to be more "directed," they may require a clear path between the tag and reader.

System 101 and other embodiments disclosed herein may be implemented with read-write or read-only RFID tags 108. With read-write chips, an application can add information to the tag or write over existing information when the tag is within range of a reader, or interrogator. Some read-only microchips have information stored on them during the manufacturing process. The information on such chips can never be changed. Another option is to use electrically erasable programmable read-only memory, or EEPROM. With EEPROM, the data can be overwritten using a special electronic process.

It is noted that one problem encountered with RFID is the signal from one reader can interfere with the signal from another where coverage overlaps. This is called reader collision. One way to avoid the problem is to use a technique called time division multiple access, or TDMA. In simple terms, the readers are instructed to read at different times, rather than both trying to read at the same time. This ensures that they don't interfere with each other. But it means any RFID tag in an area where two readers overlap will be read twice. Accordingly, in one example embodiment of the systems and methods described hereinabove, the system or method is operated so that if one reader reads a tag another reader does not read it again. Another problem readers have is reading a lot of RFID tags in the same field. Tag collision occurs when more than one chip reflects back a signal at the same time, confusing the reader. Different vendors of RFID technology have developed different systems for having the tags respond to the reader one at a time. Since they can be read in milliseconds, it appears that all the tags are being read simultaneously.

In further embodiments, physical connectors connecting the information system 120 to the reader component 106 may also be used, such as through an Ethernet connection. According to another alternate embodiment, the data transmission system 130 comprises RF transmission components passing data between the reader component 106 and the information system 120 using radio frequency transmissions.

Figure 4:
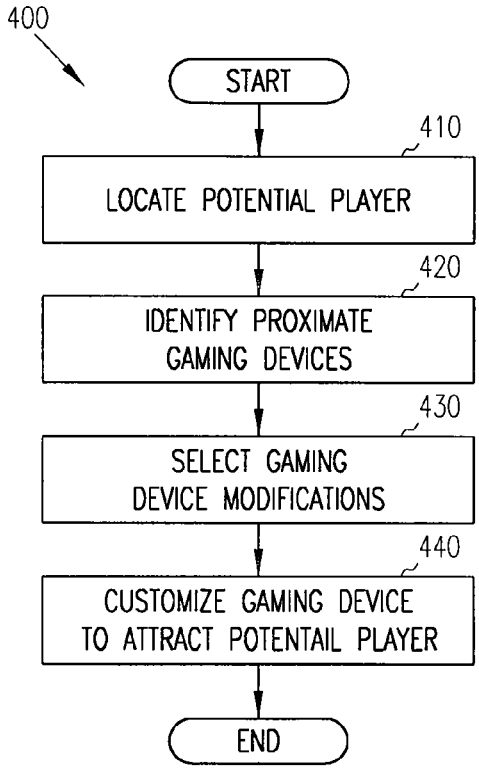
FIG. 4 is a flow chart illustrating an alternative process for customizing a gaming device as a function of a potential player in proximity to the gaming device according to an example embodiment.

FIG. 4 illustrates a generalized version of proximity based game customization at 400. At 410, the location of a potential player is identified. The identification may be made by the user of sensors, video cameras, employing various biometrics, such as face recognition programs, or other image recognition type algorithms that can be used to profile different types of players. As above, RF ID tags may also be carried by potential players. At 420, a database application is used to identify gaming devices that are proximate to the potential player. At 430, the database application is used to select gaming device modifications based on information from the database, or profile information developed from the sensors. Such gaming modifications are selected as a function of the information to be more likely to attract the potential player to the gaming device. For example, it may be found that tall players prefer a particular type of game, while shorter players prefer other types of games. Similar preferences may be found based on gender, weight, age, clothing, or accessories. Basically, any identifiable characteristic having a correlation to a preference may be used. In one embodiment, if a player cannot be individually identified, modifications based on profiling may be made as a fallback. At 440, the gaming device is customized in accordance with the identified modifications, and begins operating in a manner designed to attract the potential player that is proximate to it.

The Abstract is provided to comply with 37 C.F.R. §1.72(b) to allow the reader to quickly ascertain the nature and gist of the technical disclosure. The Abstract is submitted with the understanding that it will not be used to interpret or limit the scope or meaning of the claims.

The invention claimed is:

1. A method of customizing a gaming device, the method comprising:

identifying a potential player;

predicting a future location of the potential player by extrapolating the future location of the potential player based on past known locations of the potential player and times at the known locations;

identifying an idle gaming device proximate to the predicted future location of the potential player;

determining interests of the potential player based on interests stored in a player database; and customizing the idle gaming device as a function of the potential player interests.

2. The method of claim 1 wherein the idle gaming device is customized to begin an attract mode when the potential player is proximate to the idle gaming device.

3. The method of claim 2 wherein the idle gaming device is customized to offer a game preferred by the potential player.

4. The method of claim 1 wherein the potential player is identified by the use of a RF tag carried by the potential player.

5. The method of claim 4 wherein the RF tag is associated with the potential player and used as an index into a player database of player preferences to determine preferences of the potential player.

6. The method of claim 1 wherein the potential player is identified by the use of biometrics.

7. The method of claim 1 wherein the potential player is identified by triangulating on a cell phone carried by the potential player.

8. The method of claim 1 wherein preferences of the potential player are identified by profiling the potential player.

9. The method of claim 3 wherein the game preferred by the potential player has payouts that are also preferred by the potential player.

10. The method of claim 1 wherein the idle gaming device is customized with an attract mode based on a the sporting team of interest to the potential player, wherein the attract mode includes a display of sporting event scores of the sporting team.

11. The method of claim 1 wherein the idle gaming device is customized with commercials, themes, or playing incentives.

12. The method of claim 1 wherein the idle gaming device is customized with a language based on preferences stored in the player database for the potential player.

13. A computer-implemented method of customizing a gaming device to attract an unidentified player, the method comprising:

storing, in one or more memory devices, a plurality of profiles of different types of players, wherein the different types of players are associated with one or more observable characteristics and the profiles of the plurality are associated with one or more gaming preferences;

detecting, via at least one of one or more image sensors, one or more observable characteristics of an unidentified player positioned proximate the gaming device;

determining, via at least one of the one or more processors, one or more likely gaming preferences of the unidentified player by profiling the unidentified player based on the plurality of profiles and the detected one or more observable characteristics; and customizing, via at least one of the one or more processors, the gaming device in accordance with at least one of the one or more likely gaming preferences.

14. The computer-implemented method of claim 13, wherein the detected one or more observable characteristics includes at least one of facial features, height, weight, clothing, and accessories.

15. The computer-implemented method of claim 13, wherein detecting one or more observable characteristics includes analyzing, via facial recognition software, facial features of the unidentified player.

16. The computer-implemented method of claim 13 wherein the gaming device is customized to offer a game that is likely preferred by the unidentified player, based on the identified one or more observable characteristics.

17. The computer-implemented method of claim 13, wherein the gaming device is customized to offer wagering game payouts that are likely preferred by the unidentified player, based on the identified one or more observable characteristics.

18. The computer-implemented method of claim 13, wherein the gaming device is customized to operate an attract mode that is selected based on likely gaming preferences of the unidentified player.

19. The computer-implemented method of claim 13, wherein the gaming device is customized to provide commercials, themes, or playing incentives that are selected based on likely gaming preferences of the unidentified player.

20. The computer-implemented method of claim 13, wherein the gaming device is customized to use a language that is selected based on likely preferences of the unidentified player.

21. A computer-implemented method of customizing an idle gaming device to attract an unidentified player, the method comprising:

storing, in one or more memory devices, a plurality of profiles of different types of players, wherein the different types of players are associated with one or more observable characteristics, and the profiles of the plurality are associated with one or more gaming preferences;

detecting, via at least one of one or more image sensors, one or more observable characteristics of an unidentified player at a location in a gaming establishment;

selecting, via at least one of one or more processors, an idle gaming device proximate the location of the unidentified player;

determining, via at least one of the one or more processors, one or more likely gaming preferences of the unidentified player by profiling the unidentified player based on the plurality of profiles and the detected one or more observable characteristics; and customizing, via at least one of the one or more processors, the idle gaming device in accordance with at least one of the one or more likely gaming preferences.

22. The computer-implemented method of claim 21, wherein the detected one or more observable characteristics includes at least one of facial features, height, weight, clothing, and accessories.

23. The computer-implemented method of claim 21, wherein detecting one or more observable characteristics includes analyzing, via facial recognition software, facial features of the unidentified player.

24. The computer-implemented method of claim 21, wherein the idle gaming device is customized to offer a game that is likely preferred by the unidentified player based on the identified one or more observable characteristics.

25. A gaming system configured to automatically customize a gaming device to attract an unidentified player, the gaming system comprising:

one or more image sensors;

one or more processors; and at least one of one or more memory devices storing a plurality of profiles of different types of players, wherein the different types of players are associated with one or more observable characteristics, and the profiles of the plurality are associated with one or more gaming preferences;

at least one of the one or more memory devices storing instructions that, when executed by at least one of the one or more processors, cause the gaining system to:

detect, via at least one of the one or more image sensors, one or more observable characteristics of an unidentified player proximate the gaining device;

determining, via at least one of the one or more processors, one or more likely gaming preferences of the unidentified player by profiling the unidentified player based on the plurality of profiles and the detected one or more observable characteristics; and customizing, via at least one of the one or more processors, the gaming device in accordance with at least one of the one or more likely gaming preferences.

26. The gaming system of claim 25, wherein the gaming system is communicably connected to the gaming device via a communications network.

27. The gaming system of claim 26, wherein the detected one or more observable characteristics include at least one of facial features, height, weight, clothing, and accessories.

28. The gaming system of claim 25, wherein detecting one or more observable characteristics includes analyzing, via facial recognition software, facial features of the unidentified player.

29. A computer-readable, non-transitory medium including executable instructions that, when executed by one or more processors, cause a gaming system to perform a method comprising:

accessing, via one or more memory devices, a plurality of profiles of different types of players, wherein the different types of players are associated with one or more observable characteristics, and the profiles of the plurality are associated with one or more gaming preferences;

detecting, via at least one of one or more image sensors, one or more observable characteristics of an unidentified player at a location in a gaming establishment;

selecting, via at least one of one or more processors, an idle gaming device proximate the location of the unidentified player;

determining, via at least one of the one or more processors, one or more likely gaming preferences of the unidentified player by profiling the unidentified player based on the plurality of profiles and the detected one or more observable characteristics; and customizing, via at least one of the one or more processors, the idle gaming device in accordance with at least one of the one or more likely gaming preferences.

30. The computer-readable medium of claim 29, wherein the plurality of profiles is stored in one or more memory devices that are accessed via a communications network.

* * * * *

UNITED STATES PATENT AND TRADEMARK OFFICE

CERTIFICATE OF CORRECTION

PATENT NO. : 8,602,885 B2
APPLICATION NO. : 11/275295
DATED : December 10, 2013
INVENTOR(S) : Vladimir Arezina et al.

It is certified that error appears in the above-identified patent and that said Letters Patent is hereby corrected as shown below:

IN THE CLAIMS:

On Column 7, Line 42 (Claim 10, Line 2), please delete the word “the” between “a” and “sporting.”.

On Column 9, Line 14 (Claim 25, Line 14), please delete “gaining” and insert -- gaming --, therefor.

On Column 9, Line 17 (Claim 25, Line 17), please delete “gaining” and insert -- gaming --, therefor.

Signed and Sealed this
Second Day of December, 2014

Michelle K. Lee

Michelle K. Lee
*Deputy Director of the United States Patent and Trademark Office*